US010116071B2

(12) United States Patent
Li et al.

(10) Patent No.: US 10,116,071 B2
(45) Date of Patent: Oct. 30, 2018

(54) ELECTRICAL CONNECTOR AND CONTACTS THEREOF

(71) Applicant: FOXCONN INTERCONNECT TECHNOLOGY LIMITED, Grand Cayman (KY)

(72) Inventors: Xin-Tian Li, Kunshan (CN); Wei Yin, Kunshan (CN); Ji-Wang Jin, Kunshan (CN); Bin Peng, Kunshan (CN); Zhi-Jian Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/408,446

(22) Filed: Jan. 18, 2017

(65) Prior Publication Data

US 2017/0222348 A1 Aug. 3, 2017

(30) Foreign Application Priority Data

Feb. 1, 2016 (CN) ..... 2016 1 0069424

(51) Int. Cl.
*H01R 13/428* (2006.01)
*H01R 12/71* (2011.01)
*H01R 13/24* (2006.01)

(52) U.S. Cl.
CPC ..... *H01R 12/714* (2013.01); *H01R 13/2428* (2013.01)

(58) Field of Classification Search
CPC ..... H01R 13/2407
USPC ..... 439/873, 78, 700, 500, 862
See application file for complete search history.

(56) References Cited

U.S. PATENT DOCUMENTS 5,611,717 A * 3/1997 Joly ..... H01R 13/14 439/252
6,572,386 B1 * 6/2003 Howell ..... H01R 13/2428 439/66
6,855,010 B1 * 2/2005 Yen ..... H01R 13/2428 439/700
7,140,895 B2 * 11/2006 Tuin ..... H01R 12/57 439/246
7,556,503 B2 * 7/2009 Vinther ..... H01R 12/714 439/515
7,607,952 B2 * 10/2009 Tai ..... H01R 12/57 439/700

(Continued)

FOREIGN PATENT DOCUMENTS

TW M406291 6/2011
TW M508814 9/2015

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes an insulative housing defining a top surface and a bottom surface opposite to each other and a plurality of electrical contacts received in the insulative housing. Each electrical contact is formed by stamping a metal plate and includes a contacting portion exposed to the top surface, a mounting portion extending out of the bottom surface and an elastic portion disposed between the contacting portion and the mounting portion and in the insulative housing, wherein the elastic portion includes a first elastic portion and a second elastic portion disposed on two opposite sides of the contacting portion.

16 Claims, 6 Drawing Sheets

(56) References Cited

U.S. PATENT DOCUMENTS

| | | | | |
|---|---|---|---|---|
| 7,740,511 | B2 * | 6/2010 | Katano | H01R 13/113<br>439/816 |
| 7,928,751 | B2 * | 4/2011 | Hsu | G01R 1/06716<br>29/622 |
| 8,710,857 | B2 * | 4/2014 | Huang | G01R 1/06772<br>324/755.05 |
| 9,620,882 | B2 * | 4/2017 | Chen | H01R 13/2428 |
| 9,653,827 | B2 * | 5/2017 | Li | H01R 12/7076 |
| 2010/0136850 | A1 * | 6/2010 | Inaba | H01R 43/16<br>439/733.1 |

* cited by examiner

ELECTRICAL CONNECTOR AND CONTACTS THEREOF

BACKGROUND OF THE INVENTION

1. Field of the Invention

The present invention relates to an electrical connector and contacts thereof, particularly to an electrical connector with improved electrical contacts.

2. Description of Related Art

Electrical connector is widely used in the electronics field. Taiwan Patent No. M508814 discloses a conductive contact used for a battery connector. The conductive contact comprises an elastic connecting portion, a contacting portion and a mounting portion, and the conductive contact has a spring structure to increase the expansion space and contact the battery so as to produce an electrical connection. However, when the contacting portion is contacted to the battery, the elastic portion is elastically deformed, wherein only one end of the contact portion is connected to the elastic portion, which will lead to a lower stability and a lower service life of the conductive contact.

Hence, an electrical connector with improved structure is desired.

BRIEF SUMMARY OF THE INVENTION

Accordingly, an object of the present invention is to provide an electrical connector with an electrical contact having a well elastic strength.

To achieve the above object, an electrical connector includes an insulative housing defining a top surface and a bottom surface opposite to each other and a plurality of electrical contacts received in the insulative housing. Each electrical contact defines a first direction and a second direction perpendicular to the first direction. The electrical contact includes a contacting portion exposed to the top surface, a mounting portion extending out of the bottom surface and an elastic portion disposed between the contacting portion and the mounting portion and in the insulative housing, wherein the elastic portion includes a first elastic portion and a second elastic portion disposed on two opposite sides of the contacting portion in the second direction. The electrical connector of the invention can effectively enhance the elasticity and the stability of the electrical contact by the electrical contact having an improved structure, so that the electrical connector of the invention can be stably connected with external component in a convenient way.

Other advantages and novel features of the invention will become more apparent from the following detailed description of the present embodiment when taken in conjunction with the accompanying drawings.

DETAILED DESCRIPTION OF THE PREFERRED EMBODIMENTS

Figure 1:
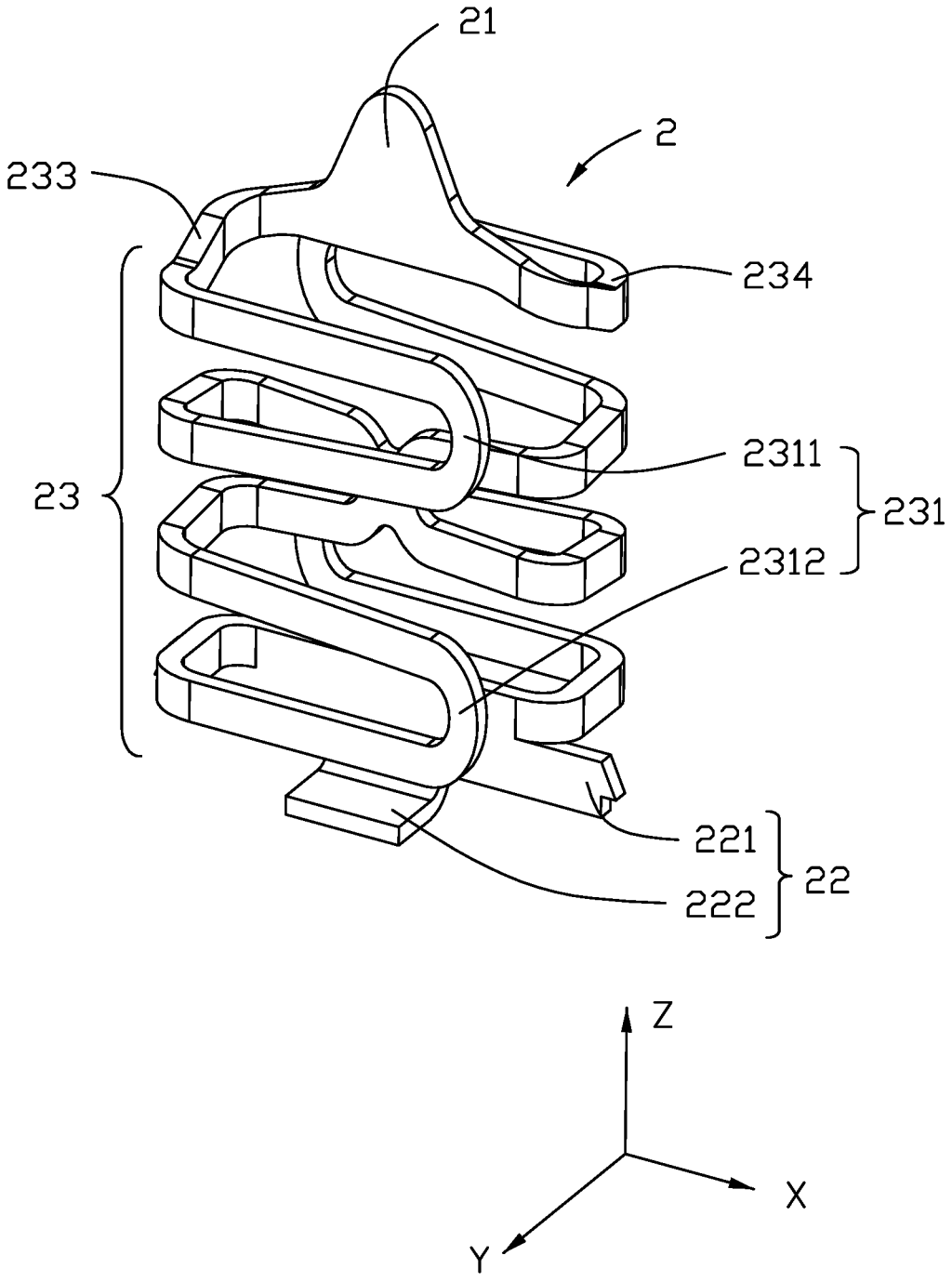
FIG. 1 is a perspective view of the electrical contact of a preferred embodiment of the present invention.
Figure 2:
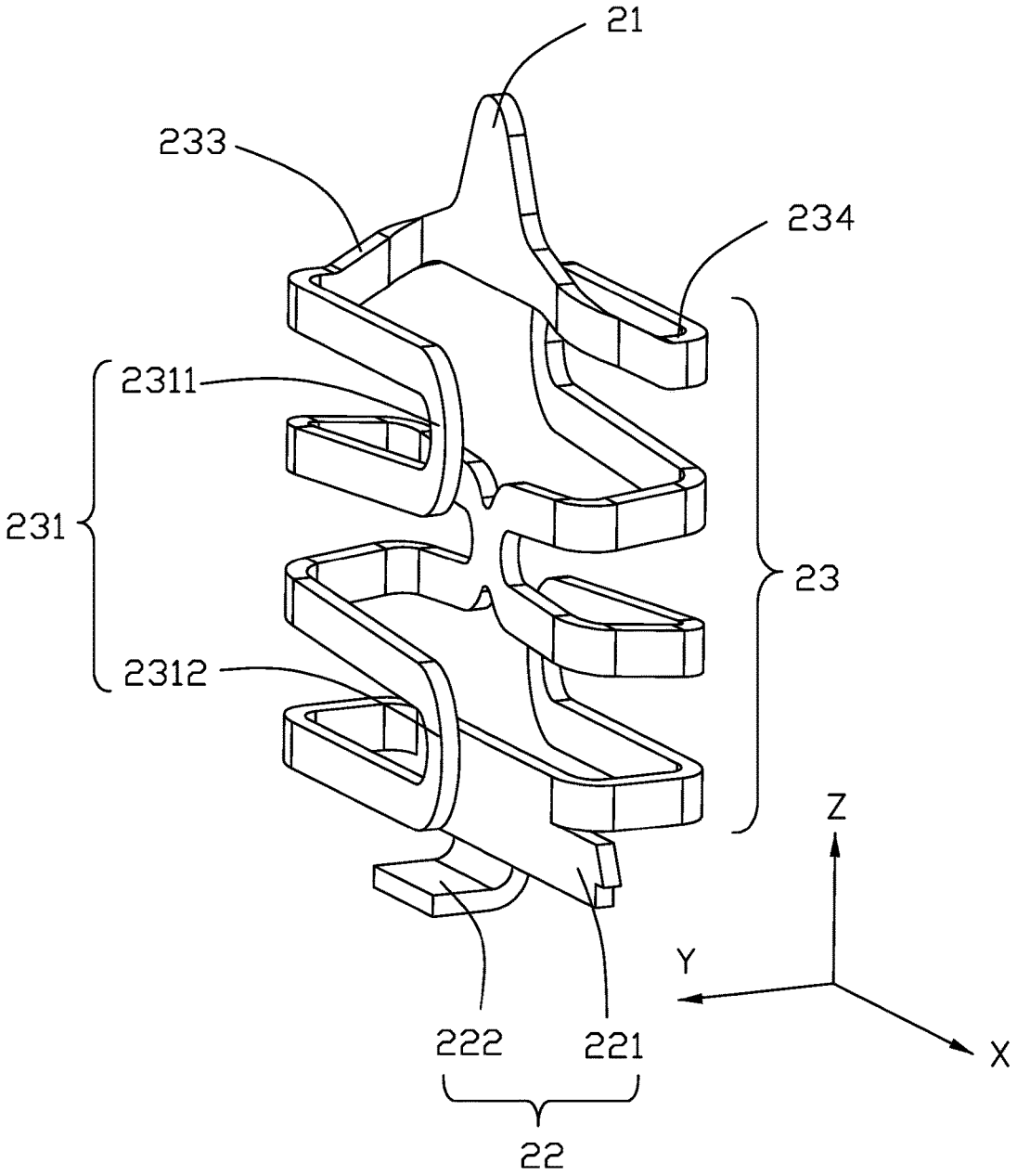
FIG. 2 is another perspective view of the electrical contact as shown in FIG. 1.
Figure 3:
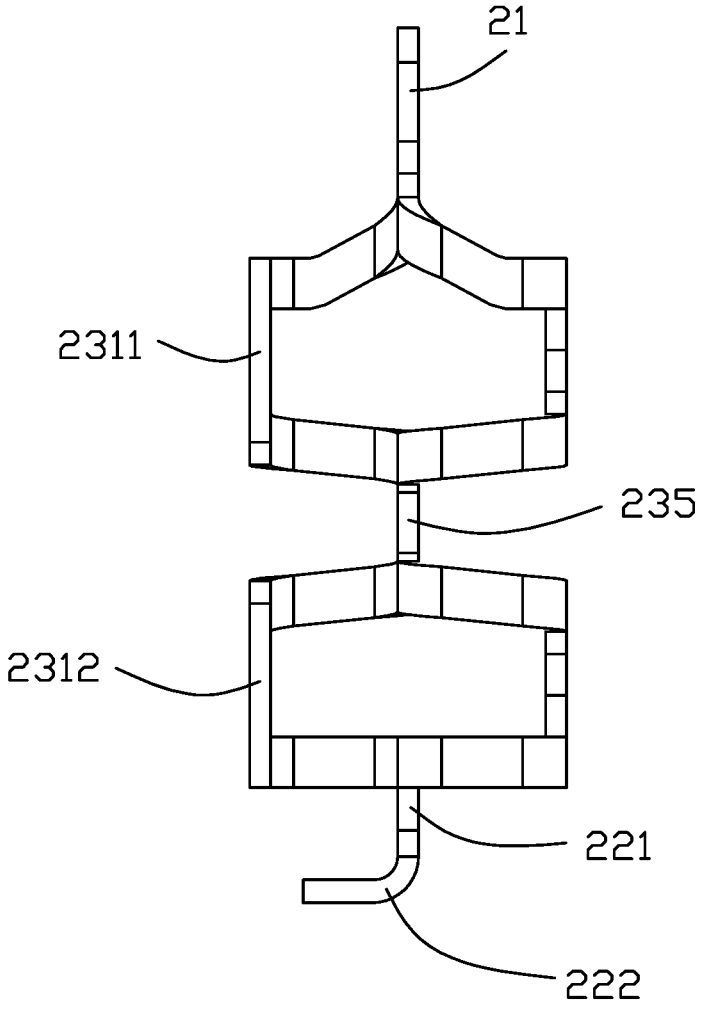
FIG. 3 is another perspective view of the electrical contact as shown in FIG. 1.

Reference will now be made to the drawing figures to describe the preferred embodiment of the present invention in details. FIGS. 1 to 6 illustrate an electrical connector 100 is assembled on a printed circuit board (not shown). The electrical connector 100 comprises an insulative housing 1 and a plurality of electrical contacts 2 received in insulative housing 1, each electrical contact 2 comprises a contacting portion 21 mating with an external component (not shown) and extending out of the top surface 11 of the insulative housing 1, a mounting portion 22 retained in the insulative housing 1 and an elastic portion 23 disposed between the contacting portion 21 and the mounting portion 22.

Reference to FIGS. 1 to 4, the electrical contact 2 defines a first direction X, a second direction Y and a third direction Z perpendicular to the first direction X and the second direction Y. The two ends of the contacting portion 21 are extending along the first direction X, the elastic portion 23 comprises a first elastic portion 231 connecting to one end of the contacting portion 21 and a second elastic portion 232 connecting to the other end of the contacting portion 21, the first elastic portion 231 and the second elastic portion 232 reversely stretch from the two sides of the contacting portion 21 along said second direction Y, and the contacting portion 21 disposed to the center of the first elastic portion 231 and the second elastic portion 232 on the second direction Y, so that the first elastic portion 231 and the second elastic portion 232 are disposed on the two sides of the contacting portion 21 in the second direction Y. Specifically, the contacting portion 21 conversely extends a first connecting portion 233 and a second connecting portion 234, which are respectively connecting said first elastic portion 231 and the second elastic portion 232 along the first direction X.

The first elastic portion 231 includes a plurality of U-shaped first elastic branches, the first elastic branches includes a first upper elastic branch 2311 disposed to the upper side of the third direction Z and a first lower elastic branch 2312 disposed to the lower side of the third direction Z, the first connecting portion 233 is connecting with said contacting portion 21 and the first upper elastic branch 2311. The second elastic portion 232 includes a plurality of U-shaped second elastic branches, the second elastic branches are includes a second upper elastic branch 2321 disposed to the upper side of the third direction Z and a second lower elastic branch 2322 disposed to the lower side of the third direction Z, the second connecting portion 234 is connecting with said contacting portion 21 and the second upper elastic branch 2321. The elastic portion 23 further includes a main body 235 disposed between the first elastic portion 231 and second elastic portion 232 and a beam portion 236 connecting the first lower elastic branch 2312 and the second lower elastic branch 2322. The main body 235 includes four connecting branches which are respectively connecting to the first upper elastic branch 2311, the second upper elastic branch 2321, the first lower elastic branch 2312 and the second lower elastic branch 2322, the beam portion 236, the main body 235 and the contacting portion 21 are in the same plane along the third direction Z. The mounting portion 22 of the electrical contact 2 defines a retaining portion 221 extending from the beam portion 236 along the third direction Z and a soldering portion 222 extending from the retaining portion 221 along the second direction Y.

Figure 4:
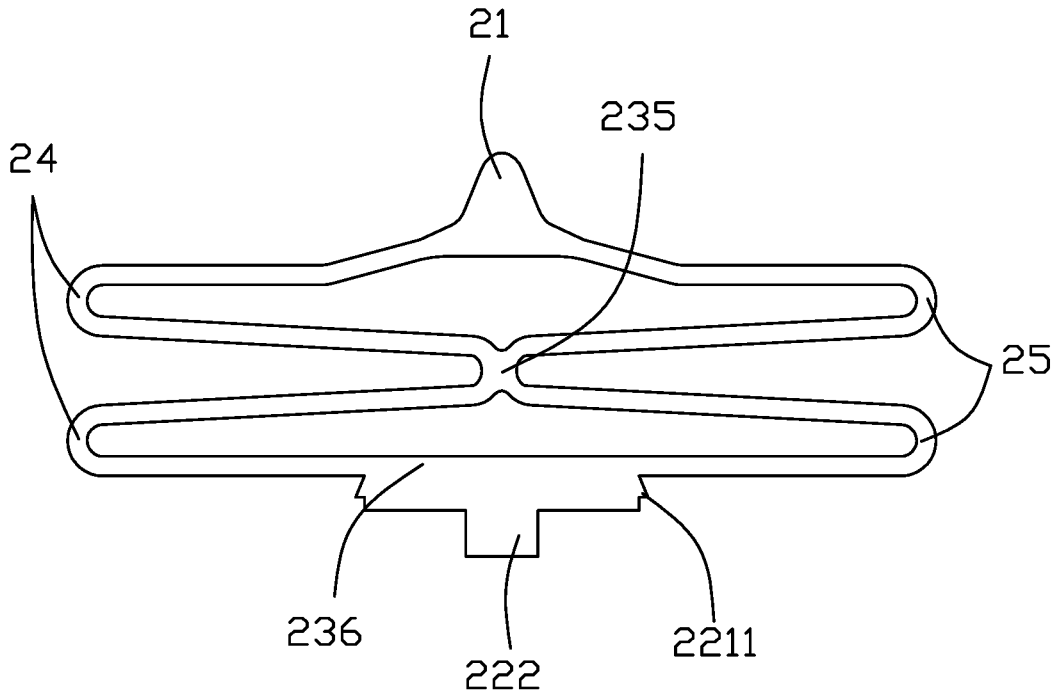
FIG. 4 is a perspective view of the electrical contact, wherein the electrical contact is flattened.

The electrical contact 2 is formed by stamping a metal plate (not shown) and comprises a contacting portion 21, a mounting portion 22 and a first elastic portion 231 and a second elastic portion 232 disposed between the contacting portion 21 and the mounting portion 22. Referring to FIG. 4, the electrical contact 2 includes the contacting portion 21, at least two left U-shaped configurations 24, at least two right U-shaped configurations 25 and the mounting portion 22 when the electrical contact 2 is flattened, every two left U-shaped configurations 24 are arranged on a up-to-down direction and connected each other, every two right U-shaped configurations 25 are arranged on the up-to-down direction and connected each other, the left U-shaped configuration 24 and the right U-shaped configuration 25 are relative to each other and connected with each other from their ends, all the left U-shaped configurations 24 and all the right U-shaped configurations 25 are bent in opposite direction to form the first elastic portion 231 and the second elastic portion 232. On the one hand, the electrical contact 2 comprises an improved structure that the contacting portion 21 is connecting to the first elastic portion 231 and the second elastic portion 232 by the first connecting portion 233 and the second connecting portion 234 to enhance the stability between the contacting portion 21 of the electrical contact 2 and the external component when the electrical connector 100 is mated with the external component. On the other hand, the contacting portion 21 is disposed on the center of the first elastic portion 231 and second elastic portion 232 in the second direction Y and disposed on the center of the first connecting portion 233 and the second connecting portion 234 in the first direction X, so that the electrical contact 2 has uniform stress and could enhance the elasticity and improve the service life.

Figure 5:
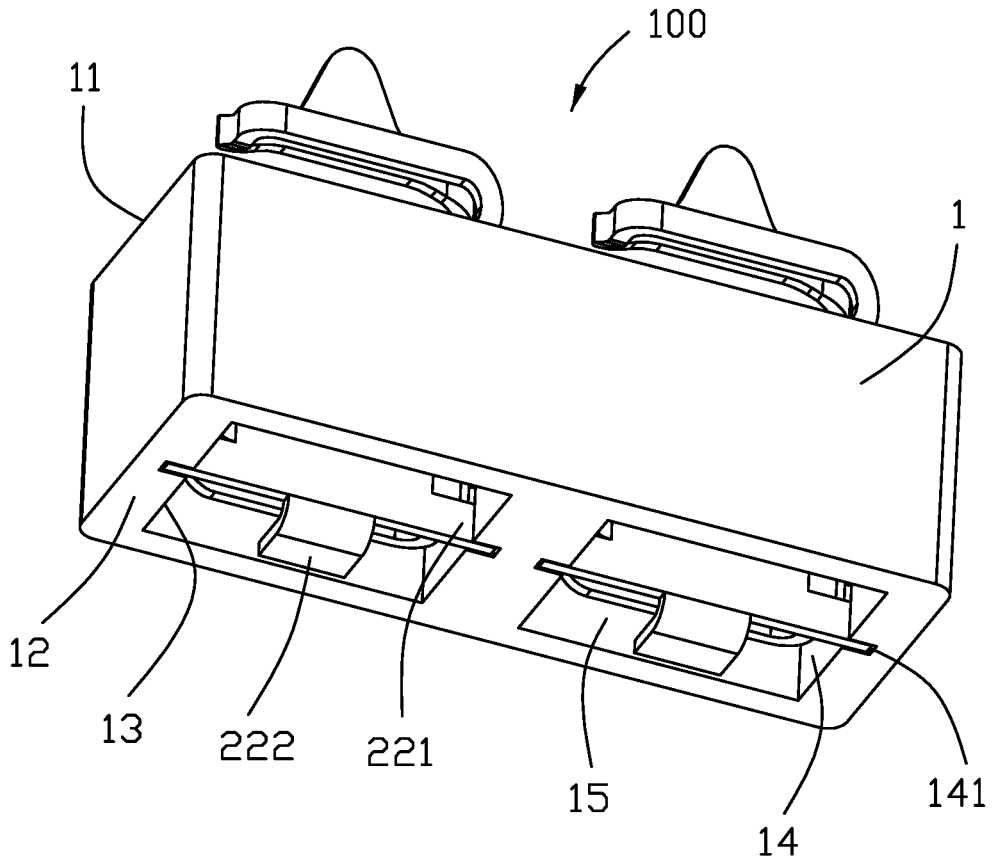
FIG. 5 is a perspective view of an electrical connector with the contacts.
Figure 6:
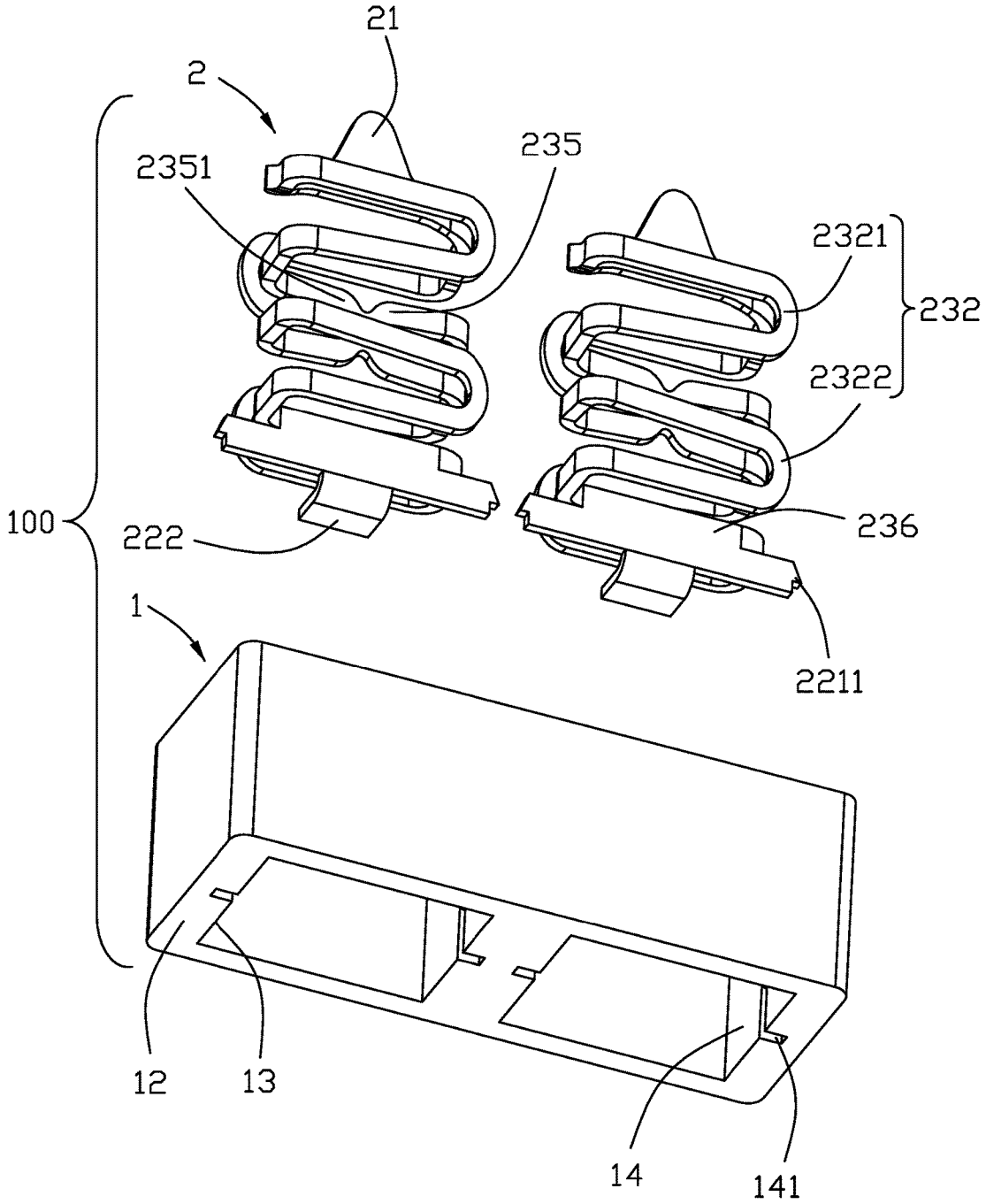
FIG. 6 is an exploded view of the electrical connector as shown in FIG. 4.

Referring to FIGS. 5 and 6, the insulative housing 1 includes a top surface 11, a bottom surface 12, a left inner surface 13 and a right inner surface 14, the insulative housing 1 further includes a plurality of contact grooves 15 running through the top surface 11 and the bottom surface 12 to receive the electrical contacts 2, each of the left inner surface 13 and the right inner surface 14 of the contact groove 15 has a retaining groove 141 recessed from the contact groove 15 and matched with the retaining portion 221, the contact groove 15 is communication with the retaining groove 141 so as to the retaining portion 221 of the electrical contact 2 being fixed in the retaining grooves 141.

Therefore, the first elastic portion 231 and the second elastic portion 232 are disposed on the two opposite sides of the mounting portion 22. The retaining portion 221 extends beyond the elastic portion 23 in the first direction X, the retaining portion 221 defines a pair of ribs 2211 disposed on the two ends thereof and retained into the retaining grooves 141 of the contact groove 15 to fix the electrical contact 2 in the insulative housing 1. The electrical connector 100 of the invention can effectively enhance the elasticity and the stability of the electrical contact 2 by the electrical contact 2 having an improved structure, so that the electrical connector 100 of the invention can be stably connected with the external component. In general, as shown in FIG. 4, the contact 2 essentially forms a "8" like structure in an extended state with an "X" main body wherein the left half of the structure is rightward folded in a lying U-shaped configuration with a rightward opening thereof in a top view, and the right half of the structure is leftward folded in a lying U-shaped configuration with a leftward opening thereof in the top view, and wherein the left half and the right half are respectively located by two sides of the main body and opposite to each other in the second direction Y. Therefore, the contact presents an S-shape viewed in the third direction Z.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical contact for use within an electrical connector having a retaining slot for retaining said contact therein, comprising:

a contacting portion, a mounting portion and an elastic portion disposed between the contacting portion and the mounting portion, the contacting portion defining two opposite ends in a first direction; wherein the elastic portion includes a first elastic portion connecting to one end of the contacting portion and a second elastic portion connecting to the other end of the contacting portion, and the first elastic portion and the second elastic portion are respectively disposed on opposite sides of the contacting portion in a second direction perpendicular to said first direction, and both provide deformable movement in a third direction perpendicular to both the first and second direction, and said electrical contact presents an S-shape viewed in said third direction.

2. The electrical contact as claimed in claim 1, wherein the first elastic portion and the second elastic portion reversely stretch from the two sides of the contacting portion along the second direction, and the contacting portion disposed on a center position between the first elastic portion and second elastic portion in the second direction.

3. The electrical contact as claimed in claim 1, wherein the first elastic portion includes a plurality of U-shaped first elastic branches, the second elastic portion includes a plurality of U-shaped second elastic branches.

4. The electrical contact as claimed in claim 3, wherein the first elastic branches include a first upper elastic branch and a first lower elastic branch along the third direction, the second elastic branches include a second upper elastic branch and a second lower elastic branch along the third direction, both the first upper elastic branch and the second upper elastic branch connect with the contacting portion.

5. The electrical contact as claimed in claim 4, wherein the elastic portion includes a main body disposed between the first elastic portion and second elastic portion, the main body includes four connecting branches, which are respectively connecting to the first upper elastic branch, second upper elastic branch, first lower elastic branch and second lower elastic branch.

6. The electrical contact as claimed in claim 5, wherein the elastic portion further includes a beam portion connecting the first lower elastic branch and the second lower elastic branch, the beam portion, the main body and the contacting portion are in a same plane, the mounting portion of the electrical contact defines a retaining portion extending from the beam portion along the third direction and a soldering portion extending from the retaining portion along the second direction.

7. The electrical contact as claimed in claim 1, wherein the electrical contact includes at least two left U-shaped configuration and at least two right U-shaped configuration disposed on opposite ends of the contacting portion when the electrical contact is flattened, every two left U-shaped configurations are arranged on a up-to-down direction and connected each other, every two right U-shaped configurations are arranged on the up-to-down direction and connected each other.

8. The electrical contact as claimed in claim 7, wherein the left U-shaped configuration and the right U-shaped configuration are relative to each other and connected with each other from their ends, all the left U-shaped configurations and all the right U-shaped configurations are bent in opposite direction to form the first elastic portion and the second elastic portion.

9. The electrical contact as claimed in claim 1, when the contact are shown in a metal plate, the contact comprises at least one left diverse U-shaped configurations and at least one right diverse U-shaped configurations, upper ends of the left and right diverse U-shaped configurations connect to the contact portion, and lower ends of the left and right diverse U-shaped configurations connect to the mounting portion.

10. The electrical contact as claimed in claim 9, wherein the left and right diverse U-shaped configurations are folded in opposite directions.

11. An electrical connector comprising:

an insulative housing with at least one passageway extending therethrough in a vertical direction;

at least one conductive contact disposed in the passageway, said contact including a "8" like structure in an extended state with an "X" like main body, a left half of the structure being rightward folded in a lying U-shaped configuration with a rightward opening thereof in a top view, and a right half of the structure being leftward folded in a lying U-shaped configuration with a leftward opening thereof in the top view, wherein the left half and the right half are not only respectively located by two sides of the main body but also opposite to each other in a front-to-back direction perpendicular to the vertical direction.

12. The electrical connector as claimed in claim 11, wherein the contact is symmetric with regard to the main body in either the front-to-back direction or a left-to-right direction perpendicular to both said vertical direction and said front-to-back direction.

13. The electrical connector as claimed in claim 11, wherein said housing includes a retaining groove in the passageway, and the contact includes a mounting portion retained in the retaining groove.

14. The electrical connector as claimed in claim 13, wherein said mounting portion further includes a horizontally extending solder pad.

15. The electrical connector as claimed in claim 13, wherein said retaining groove is located in a vertical center plane of the passageway.

16. The electrical connector as claimed in claim 13, wherein and said retaining groove is essentially coplanar with the main body.

* * * * *